US005691288A

United States Patent [19]

Dhillon

[11] Patent Number: 5,691,288

[45] Date of Patent: Nov. 25, 1997

[54] FINISHER-PRESERVER-CLEANER COMPOSITION FOR LITHOGRAPHIC PRINTING PLATES

[75] Inventor: Major S. Dhillon, Belle Mead, N.J.

[73] Assignee: Bayer Corporation, Pittsburgh, Pa.

[21] Appl. No.: 620,197

[22] Filed: Mar. 29, 1996

[51] Int. Cl.[6] ..... C11D 3/30; C11D 3/44

[52] U.S. Cl. ..... 510/171; 510/170; 510/171; 510/174; 510/178; 510/474; 510/477; 510/484

[58] Field of Search ..... 510/170, 171, 510/174, 178, 474, 477, 484

[56] References Cited

U.S. PATENT DOCUMENTS

| | | | |
|---|---|---|---|
| 4,370,404 | 1/1983 | Tachikawa et al. | 430/302 |
| 4,504,406 | 3/1985 | Dhillon | 252/143 |
| 4,664,721 | 5/1987 | Valasek | 134/26 |
| 4,873,174 | 10/1989 | Dhillon et al. | 430/309 |
| 4,880,555 | 11/1989 | Walls et al. | 252/143 |

*Primary Examiner*—Paul Lieberman
*Assistant Examiner*—Charles I. Boyer
*Attorney, Agent, or Firm*—Roberts & Mercanti, L.L.P.

[57] ABSTRACT

A composition for finishing, preserving and cleaning lithographic printing plates which is composed of a polyol having a molecular weight in the range of from about 50 to about 3,000; a starch or dextrin hydrophilic film former; an alkyl benzene sulfonate amine salt; a composition of hydrocarbons containing less than about 10% aromatics and having a boiling point in the range of 175° F. to 500° F. and a flash point of above 100° F.; a hydrogen, isooctyl, nonyl, decy or dodecyl substituted phenoxypoly(oxyethylene) ethanol surfactant having an HLB of 8 to 15; a $C_{12}$ to $C_{20}$ alcohol; mono-, di- or tri- ethanolamine; an organic or inorganic acid and water. The optional inclusion of a buffer salt and bacteriostat is preferred.

20 Claims, No Drawings

FINISHER-PRESERVER-CLEANER COMPOSITION FOR LITHOGRAPHIC PRINTING PLATES

BACKGROUND OF THE INVENTION

1. Field of the Invention

The invention relates to a composition for finishing, preserving and cleaning lithographic printing plates which have been imagewise exposed and developed.

2. Description of the Prior Art

Lithographic printing is a well known and established art. In general, the process involves applying ink to paper from a flat anodized aluminum sheet or plate having substantially no surface relief. Image differentiation depends on differing ink attraction properties of the image and non-image areas of the surface. In lithography, the image to be reproduced is imparted to the plate by any of several methods, well known to those skilled in the art, in such a way that the non-image areas are rendered hydrophilic while the image areas are oleophilic and hydrophobic. A widely practiced technique employs a photosensitive coating for this purpose.

Image differentiation is possible due to the attraction of ink to image areas of the printing plate and a similar retention of an aqueous dampening fluid by non-image areas. When the entire surface is moistened by an aqueous solution and ink thereafter applied to the surface, the image areas will repel the water and the non-image area retain the water. Upon application of ink, the image portion retains the ink and the moistened non-image areas repel it. The ink on the image area is then transferred to the surface of the material on which the image is to be reproduced, such as paper, via an offset blanket. The most common type of lithographic plate to which the present invention is directed has a coating of a light sensitive substance that is adherent to the aluminum base sheet. Depending on the nature of the photosensitive coating employed, the plate may be positive or negative working. In both cases, the image area is oleophilic and the non-image areas are hydrophilic. Exposure is effected through a transparent mask, wherein the light sensitive layer, in the negative working case, hardens and becomes insoluble in a developing solution. Following exposure of the photosensitive coating to imagewise modulated light, the latent image is developed and a portion of the coating is removed from the plate. The remaining areas become the portions which attract greasy ink and are called the image areas. The surface underlying the areas from which the light sensitive coating have been removed are hydrophilic, do not attract greasy ink and are the non-image areas.

It is known in the art that after repeated use of the plate and ageing of the surface, that the non-image areas are less able to repel ink and may tend to retain some of this ink. This is called scumming. Therefore, if the surface properties between the image and non-image areas are disturbed, for example, if the hydrophilic property of the non-image areas is deteriorated for some reason, inks are likely to adhere to such areas with deteriorated hydrophilicity and cause background stains. Such background stains are formed under a variety of conditions, for example where a lithographic printing plate is subjected to a burning-in treatment for the purpose of increasing length of run, or in the case where the surface of a plate is allowed to stand in the air without protecting it with a desensitizing gum. It is usual in the art that lithographic printing plates which are ready for printing must be subjected to such a protective finishing treatment before they are stored for prolonged periods of time. As a typical treating solution a gum arabic solution is very widely used. Dextrin and polyvinyl alcohol solutions are also known. U.S. Pat. No. 4,033,919 teaches a combination of polymers of acrylamide containing carboxy groups with acids as desensitizing agents for plates. After treatment with a desensitizing solution, printing plates are usually stored for some time. It has been found that the oleophilic character, i.e. ink receptivity of the image areas of the plate is often considerably reduced upon storage, so that a large amount of paper is wasted on roll-up. In prolonged storage of desensitized plates, undesired reactions may also occur between the desensitizing material and the surface of the support, and as a result, the hydrophilic properties of the plate are impaired. Therefore, a good finisher/preserver must function to desensitize the non-image areas to assure that they will not accept greasy ink upon printing, and prevent blinding in the image areas. It must also prevent oxidation of the background areas of the plate during storage or while waiting for press mounting. It must also be quickly removable from the plate so that it will not cause production delays. Typically a finisher must be quickly removable by a water rinse or most preferably must be removable by the fountain solution on the press. Quick roll-up is then essential in order to prevent paper waste and reduced production time.

When a lithographic printing plate has become contaminated, such contaminated areas are rendered oil sensitive and result in background stains. The appearance of fingerprints in the background of prints is also attributed to this condition. In addition, when the non-image areas take scratches, the scratches are filled with ink and are rendered oil sensitive and cause stains. In these cases, it is usual that the printing ink is first removed from the plate and then the stained areas are treated with a plate cleaner to restore the hydrophilic property of the non-image areas. Cleansing agents usually consist of dispersions and contain a number of heterogeneous substances such as those described in U.S. Pat. No. 2,780,168. Various other plate cleaning compositions are known as taught by U.S. Pat. Nos. 3,108,535; 3,289,577; 3,060,848; 4,162,920; 2,780,186; 3,679,479; and 3,489,561. In general, when stains are generated during the printing process, the surface is first treated with a hydrocarbon solvent to remove the ink and then with a desensitizing agent. This means in many cases that two steps are required.

Compositions for finishing, cleaning and preserving lithographic printing plates are well known in the art as exemplified by U.S. Pat. No. 4,162,920. Such are generally composed of an emulsion of an aqueous phase and a solvent phase. Principally the solvent phase dissolves the greasy inks built up on the plate, and the aqueous phase deposits on the image and non-image areas to protect them from atmospheric attack and to restore hydrophilicity to the background areas. It is known to use gum arabic and dextrins, such as tapioca dextrin as a surface preserver in the aqueous phase. Dextrins are obtained through either acid or alkaline hydrolysis of starches. Such dextrins are typically HCl hydrolyzed tapioca starches in the aqueous phase.

It has been a problem in the art to produce an emulsion that is stable, i.e. wherein the aqueous and solvent phases do not readily separate. U.S. Pat. No. 4,880,555 discloses a finisher, preserver, cleaner emulsion formulated with a maltodextrin prepared by enzyme hydrolysis of corn or potato starch. This latter patent requires the use of a mixture of a $C_{18}$ to $C_{30}$ alcohol and an aminated, aliphatic $C_8$ to $C_{24}$ alcohol sulfate as a stabilizer. All of the above patents are incorporated herein by reference. It has now been found that an improved finisher-preserver-cleaner, having improved emulsion stability can be prepared by the substitution of an alkyl benzene sulfonate amine salt for the mixture of $C_{18}$ to $C_{30}$ alcohol and aminated, aliphatic $C_8$ to $C_{24}$ alcohol sulfate.

SUMMARY OF THE INVENTION

The invention provides a composition for finishing, preserving and cleaning lithographic printing plates consisting essentially of a stable emulsion of:

(a) from about 0.1% to about 7.0% by weight of the composition of a polyol selected from the group consisting of ethylene glycol, propylene glycol, sorbitol and glycerin having a molecular weight in the range of from about 50 to about 3,000;

(b) from about 1.0% to about 15.0% by weight of the composition of a hydrophilic film former selected from the group consisting of starches and dextrins;

(c) from about 0.5% to about 2.0% by weight of the composition of an alkyl benzene sulfonate amine salt;

(d) from about 1.0% to about 20.0% by weight of the composition of a composition of hydrocarbons having a boiling point in the range of from about 175° F. to about 500° F., and a flash point of above about 100° F., said composition of hydrocarbons containing less than about 10% aromatic components; and (e) from about 0.1% to about 5.0% by weight of the composition of a substituted phenoxypoly(oxyethylene) ethanol wherein the substitution is H, isooctyl, nonyl, decy or dodecyl, having a hydrophile/lipophile balance of from about 8 to about 15; and (f) from about 0.1% to about 2.0% of a $C_{12}$ to $C_{20}$ alcohol;

(g) from about 0.01% to about 1.0% by weight of the composition of a mono-, di- or tri- ethanolamine; and (h) a sufficient amount of an organic or inorganic acid to impart a pH to the composition of from about 2.5 to about 6.5; and (i) sufficient water to formulate an effective finishing, preserving and cleaning composition for lithographic printing plates.

DETAILED DESCRIPTION OF THE PREFERRED EMBODIMENT

In the practice of the present invention, a finishing, preserving and cleaning composition is prepared which is broadly composed of a polyol; a hydrophilic film former; alkyl benzene sulfonate amine salt; a composition of hydrocarbons preferably containing 100% aliphatic components; a substituted phenoxypoly(oxyethylene)ethanol; a $C_{12}$ to $C_{20}$ alcohol; a mono-, di- or tri- ethanolamine; an acid to impart a pH to the composition of from about 2.5 to about 6.5; water; and preferably a buffer to maintain the pH, and a bacteriostat/fungistat component.

The polyol component is preferably an ethylene glycol, sorbitol, propylene glycol or glycerin having a molecular weight in the range of from about 50 to about 3,000, preferably about 150 to about 1,000. The most preferred compound is Carbowax 200 available from Union Carbide and has a molecular weight of about 200. It is preferably present in an amount of from about 0.1% to about 7% by weight of the composition. A more preferred range is from about 0.5% to about 5% and most preferably from about 1% to about 2%.

The composition then contains a hydrophilic film former component. Suitable components non-exclusively include potato starch, corn starch, tapioca dextrin and a maltodextrin obtained by the enzyme hydrolysis of corn or potato starch. The most preferred film former is a maltodextrin is obtained by the enzyme hydrolysis of corn or potato starch. The maltodextrin has a viscosity of from about 6,000 to about 9,000 cps when measured as a 25% solution in deionized water at 22° C. This component is preferably present in the overall composition in an amount of from about 1% to about 15%, more preferably from about 3% to about 10% and most preferably from about 4% to about 6%. The most preferred component is STAR-DRI 20, available commercially from Staley Industrial Products of Decatur, Ill.

The composition then contains an alkyl benzene sulfonate amine salt which is preferably a $C_{10}$ to $C_{16}$ alkyl benzene sulfonate amine salt. The most preferred component is Calimulse PRS which is available commercially from Pilot Chemical Company of Santa Fe Springs, Calif. It is preferably present in the composition in an amount of from about 0.05% to about 2% by weight of the composition, more preferably from about 0.1% to about 1% and most preferably from about 0.2% to about 0.4%.

The composition contains one or more a hydrocarbons having a boiling point in the range of from about 175° F. to about 500° F., and a flash point of above about 100° F. This composition of hydrocarbons contains less than about 10% aromatic components and preferably 100% aliphatic components. It is present in an amount of from about 1% to about 20% by weight of the composition, preferably from about 5% to about 15% and most preferably from about 8% to about 12%. Suitable components include Isopar G, H, K, L, and M, as well as Norpar 12 and 13, all available from Exxon. Isopar L is most preferred.

The composition contains a certain non-ionic surfactant which is a substituted phenoxypoly(oxyethylene)ethanol wherein the substitution is H, isooctyl, nonyl, decy or dodecyl, having a hydrophile/lipophile balance of from about 8 to about 15. It is preferably present in an amount of from about 0.1% to about 5% by weight of the composition, more preferably from about 0.2% to about 2% and most preferably from about 0.5% to about 1%. Suitable surfactants include Igepal CA-520, CA-620, CA-630, CA-720 and RC-520 available from GAF and Triton X-100 from Rohm & Haas. The most preferred compound is Igepal RC-520 with a hydrophile/lipophile balance (HLB) of 13.5.

The composition then contains a $C_{12}$ to $C_{20}$ alcohol which is preferably oleyl alcohol. Such is commercially available from Ashland Chemical Company of Columbus Ohio as Adol 320. It is preferably present in an amount of from about 0.1% to about 2% based on the weight of the composition, preferably from about 0.2% to about 1% and more preferably from about 0.4% to about 0.6%.

The composition then contains from about 0.01% to about 1.0% by weight of the composition of a mono-, di- or tri-ethanolamine. Triethanolamine is most preferred. It is preferably present in an amount of from about 0.02 to about 1% and more preferably from about 0.02 to about 1% by weight of the composition.

The composition also contains a sufficient amount of an organic or inorganic acid to impart a pH to the composition of from about 2.5 to about 6.5. Such acids non-exclusively include citric, phosphoric, ascorbic, sorbic, tartaric, phthalic, boric and sulfuric acids. A more preferred pH range is from about 4 to about 5 and about 4.5 being the most preferred case. The acid component is preferably present in an amount of from about 0.001% to about 1% and more preferably from about 0.01 to about 0.06% and most preferably from about 0.02 to about 0.04% by weight of the composition.

The composition then contains sufficient water as the balance to formulate an effective finishing, preserving and cleaning composition for lithographic printing plates. Soft water or deionized water are most preferred.

The composition further contains an optional salt buffer. Such non-exclusively include an ammonium, alkali metal or alkaline earth metal salt of an organic or inorganic acid, such as one of the above acids, in an amount effective to maintain the pH of the composition in the desired range. The buffer, when one is use is usually present in an amount of from about 0.1% to about 8%, more preferably from about 0.5% to about 5% and most preferably from about 1% to about 3%. Although additional amounts apparently are not detrimental, excess would not be economical.

The composition also may contain an optional bacteriostat/fungistat. It is preferably present in an amount of from about 0.01% to about 0.5% by weight of the composition, more preferably from about 0.03% to about 0.3% and most preferably from about 0.05% to about 0.2%. The most preferred compound is acetoxy-dimethoxydioxane available from Givagaudin as Givgard DXN.

The following non-limiting examples serve to illustrate the invention.

EXAMPLE 1

| Component | Weight percent |
|---|---|
| Water | 78.0970 |
| Star Dri 20 (Staley Industrial Products) | 5.5230 |
| Givgard DXN (Givagaudin) | 0.1030 |
| Phosphoric acid (85%) | 0.0300 |
| Monosodium phosphate | 2.4770 |
| Carbowax 200 | 1.2450 |
| Isopar L (Exxon) | 10.9960 |
| Adol 320 (Oleyl alcohol) | 0.5018 |
| Igepal RC 520 (GAF) | 0.7490 |
| Calimulse PRS (Alkylbenzene sulfonate, amine salt) | 0.2449 |
| Triethanolamine | 0.0333 |

This emulsion was tested for accelerated aging at 80° C. The emulsion was stable for more than 5 days.

Exposed and developed N61 negative acting lithographic printing plates produced by Enco Printing Products division of Hoechst Celanese Corporation were finished with this emulsion, kept for two days at 30° C. and then run on a Heidelberg printing press. The plate finished with this emulsion gave acceptable roll-up impression within 15 sheets whereas a control plate without this emulsion gave acceptable printed sheet after 30 sheets.

Exposed and developed N61 negative acting lithographic printing plates produced by Enco Printing Products division of Hoechst Celanese Corporation running on a Heidelberg printing press were allowed to set on press for a time sufficient to prevent clean rollup. Unacceptable printing in this case is called as background scum. The scummed plate is cleaned is cleaned with emulsion. After cleaning, an acceptable printed impression is obtained in 15 sheets while the untreated plate continues to print an unacceptable printed sheets.

EXAMPLE 2 (Comparative)

A composition for finishing, preserving and cleaning lithographic printing plates is prepared by forming an emulsion by mixing the following components:

| Component | Weight percent |
|---|---|
| Water | 78.0970 |
| Star Dri 20 (Staley Industrial Products) | 5.5230 |
| Givgard DXN (Givagaudin) | 0.1030 |
| Phosphoric acid (85%) | 0.0300 |
| Monosodium phosphate | 2.4770 |
| Carbowax 200 | 1.2450 |
| Isopar L (Exxon) | 10.9960 |
| Adol 320 (Oleyl alcohol) | 0.7800 |
| Igepal RC 520 (GAF) | 0.7157 |
| Triethanolamine | 0.0333 |

This emulsion was tested for accelerated aging at 80° C. The emulsion was stable for only 30 minutes and then the emulsion breaks down.

EXAMPLE 3

| Component | Weight percent |
|---|---|
| Water | 78.0970 |
| Star Dri 20 (Staley Industrial Products) | 5.5230 |
| Givgard DXN (Givagaudin) | 0.1030 |
| Phosphoric acid (85%) | 0.0300 |
| Monosodiuin phosphate | 2.4770 |
| Carbowax 200 | 1.2450 |
| Isopar L (Exxon) | 10.9960 |
| Adol 320 (Oleyl alcohol) | 0.4995 |
| Igepal RC 520 (GAF) | 0.7157 |
| Calimulse PRS | 0.2805 |
| Triethanolamine | 0.0333 |

The emulsion of this example was found to be acceptable when tested according to the procedures given in Example 1.

EXAMPLE 4

| Component | Weight percent |
|---|---|
| Water | 78.0970 |
| Star Dri 20 (Staley Industrial Products) | 5.5230 |
| Givgard DXN (Givagaudin) | 0.1030 |
| Phosphoric acid (85%) | 0.0300 |
| Monosodium phosphate | 2.4770 |
| Carbowax 200 | 1.2450 |
| Isopar L (Exxon) | 10.9960 |
| Adol 320 (Oleyl alcohol) | 0.4995 |
| Calimulse PRS | 0.2472 |
| Igepal RC 520 (GAF) | 0.7490 |
| Triethanolamine | 0.0333 |

The emulsion of this example was found to be acceptable when tested according to the procedures given in Example 1.

EXAMPLE 5

| Component | Weight percent |
|---|---|
| Water | 78.097 |
| Star Dri 20 (Staley Industrial Products) | 5.5230 |
| Givgard DXN (Givagaudin) | 0.1030 |
| Phosphoric acid (858) | 0.0300 |
| Monosodium phosphate | 2.4770 |
| Carbowax 200 | 1.2450 |
| Isopar L (Exxon) | 10.9960 |

-continued

| Component | Weight percent |
|---|---|
| Adol 320 (Oleyl alcohol) | 0.4995 |
| Calimulse PRS | 0.2472 |
| Igepal RC 520 (GAF) | 0.7490 |
| Triethanolaimine | 0.0333 |

The emulsion of this example was found to be acceptable when tested according to the procedures given in Example 1.

EXAMPLE 6

As a comparison, Example 1 is repeated except a single component is sequentially removed from each of samples A through J.

| | A | B | C | D | E |
|---|---|---|---|---|---|
| Star Dri 20 | — | 5.5230 | 5.5230 | 5.5230 | 5.5230 |
| Givgard DXN | 0.1030 | — | 0.1030 | 0.1030 | 0.1030 |
| Phosphoric acid (85%) | 0.0300 | 0.0300 | — | 0.0300 | 0.0300 |
| Monosodium phosphate | 2.4770 | 0.0300 | 0.0300 | — | 0.0300 |
| Carbowax 200 | 1.2450 | 0.0300 | 0.0300 | 0.0300 | — |
| Isopar L | 10.9960 | 10.9960 | 10.9960 | 10.9960 | 10.9960 |
| Adol 320 | 0.5018 | 0.5018 | 0.5018 | 0.5018 | 0.5018 |
| Igepal RC 520 | 0.7490 | 0.7490 | 0.7490 | 0.7490 | 0.7490 |
| Calimulse PRS | 0.2449 | 0.2449 | 0.2449 | 0.2449 | 0.2449 |
| Triethanolamine | 0.0333 | 0.0333 | 0.0333 | 0.0333 | 0.0333 |
| Water to 100% | Balance | Balance | Balance | Balance | Balance |

| | F | G | H | I | J |
|---|---|---|---|---|---|
| Star Dri 20 | 5.5230 | 5.5230 | 5.5230 | 5.5230 | 5.5230 |
| Givgard DXN | 0.1030 | 0.1030 | 0.1030 | 0.1030 | 0.1030 |
| Phosphoric acid (85%) | 0.0300 | 0.0300 | 0.0300 | 0.0300 | 0.0300 |
| Monosodium phosphate | 2.4770 | 0.0300 | 0.0300 | 0.0300 | 0.0300 |
| Carbowax 200 | 1.2450 | 0.0300 | 0.0300 | 0.0300 | 0.0300 |
| Isopar L | — | 10.9960 | 10.9960 | 10.9960 | 10.9960 |
| Adol 320 | 0.5018 | — | 0.5018 | 0.5018 | 0.5018 |
| Igepal RC 520 | 0.7490 | 0.7490 | — | 0.7490 | 0.7490 |
| Calimulse PRS | 0.2449 | 0.2449 | 0.2449 | — | 0.2449 |
| Triethanolamine | 0.0333 | 0.0333 | 0.0333 | 0.0333 | — |
| Water to 100% | Balance | Balance | Balance | Balance | Balance |

Results:

Sample A Unstable emulsion. No plate finishing or reserving.

Sample B Useful composition, but some unwanted bacteria growth.

Sample C Composition not useful. Background toning on plate.

Sample D Useful composition, but some minor background toning.

Sample E Composition not useful. No composition lubricity.

Sample F Composition not useful. No emulsion or ink removal.

Sample G Composition not useful. Unstable emulsion.

Sample H Composition not useful. Poor lubricity. Non-uniform film formation.

Sample I Unstable emulsion. Very long emulsion formation time.

Sample J Composition not useful. Poor shelf stability.

As can been seen from this data, the composition of this invention as seen in Example 1, produces a stable emulsion composition for finishing, preserving and cleaning lithographic printing plates whereas, the elimination of any component of the composition produces a composition which is either not useful or less useful for this purpose.

What is claimed is:

1. A composition for finishing, preserving and cleaning lithographic printing plates consisting essentially of a stable emulsion of:

(a) from about 0.1% to about 7.0% by weight of the composition of a polyol selected from the group consisting of ethylene glycol, propylene glycol, sorbitol and glycerin having a molecular weight in the range of from about 50 to about 3,000;

(b) from about 1.0% to about 15.0% by weight of the composition of a hydrophilic film former selected from the group consisting of starches and dextrins;

(c) from about 0.5% to about 2.0% by weight of the composition of an alkyl benzene sulfonate amine salt;

(d) from about 1.0% to about 20.0% by weight of the composition of a composition of hydrocarbons having a boiling point in the range of from about 175° F. to about 500° F., and a flash point of above about 100° F., said composition of hydrocarbons containing less than about 10% aromatic components; and (e) from about 0.1% to about 5.0% by weight of the composition of a substituted phenoxypoly (oxyethylene)ethanol wherein the substitution is H, isooctyl, nonyl, decy or dodecyl, having a hydrophile/lipophile balance of from about 8 to about 15; and (f) from about 0.1% to about 2.0% of a $C_{12}$ to $C_{20}$ alcohol;

(g) from about 0.01% to about 1.0% by weight of the composition of a mono-, di- or tri- ethanolamine; and (h) a sufficient amount of an organic or inorganic acid to impart a pH to the composition of from about 2.5 to about 6.5; and (i) sufficient water to formulate an effective finishing, preserving and cleaning composition for lithographic printing plates.

2. The composition of claim 1 wherein component (a) comprises a polyethylene glycol having an average molecular weight of about 200.

3. The composition of claim 1 wherein component (b) comprises a material selected from the group consisting of potato starch, corn starch, tapioca dextrin and a maltodextrin obtained by the enzyme hydrolysis of corn or potato starch.

4. The composition of claim 1 wherein said component (b) comprises a maltodextrin obtained by the enzyme hydrolysis of corn starch or potato starch.

5. The composition of claim 1 wherein component (c) comprises a $C_{10}$ to $C_{16}$ alkyl benzene sulfonate amine salt.

6. The composition of claim 1 wherein component (d) comprises a mixture of naphthenes and paraffins having substantially 100% aliphatic components.

7. The composition of claim 1 wherein component (f) comprises oleyl alcohol.

8. The composition of claim 1 wherein component (g) comprises triethanolamine.

9. The composition of claim 1 wherein compound (h) comprises an acid selected from the group consisting of citric, phosphoric, ascorbic, sorbic, tartaric, phthalic, boric and sulfuric acids.

10. The composition of claim 1 wherein component (h) comprises phosphoric acid.

11. The composition of claim 1 further comprising a sufficient amount of a buffer compound, which is an ammonium, alkali metal or alkaline earth metal salt of an organic or inorganic acid, effective to maintain the pH of the composition in the range of from about 2.5 to about 6.5.

12. The composition of claim 11 wherein said buffer is present in an amount of at least about 0.5% by weight of the composition.

13. The composition of claim 11 wherein said buffer comprises an ammonium, alkali metal or alkaline earth metal salt of an acid selected from the group consisting of citric, phosphoric, ascorbic, sorbic, tartaric, phthalic, boric and sulfuric acids.

14. The composition of claim 1 further comprising at least one bacteriostat or fungistat compound.

15. The composition of claim 14 wherein said bacteriostat or fungistat is present in an amount of at from about 0.001% to about 1.0% by weight of the composition.

16. The composition of claim 14 wherein said bacteriostat or fungistat comprises acetoxy-dimethoxydioxane.

17. The composition of claim 1 wherein component (a) comprises a polyethylene glycol having an average molecular weight of about 200; component (b) comprises a maltodextrin obtained by the enzyme hydrolysis of corn or potato starch; component (d) comprises a mixture of naphthenes and paraffins having substantially 100% aliphatic components; component (f) comprises oleyl alcohol; component (g) comprises triethanolamine; component (h) comprises an acid selected from the group consisting of citric, phosphoric, ascorbic, sorbic, tartaric, phthalic, boric and sulfuric acids; the composition further comprising a sufficient amount of a buffer compound, which is an ammonium, alkali metal or alkaline earth metal salt of an organic or inorganic acid, effective to maintain the pH of the composition in the range of from about 2.5 to about 6.5; and the composition further comprising at least one bacteriostat or fungistat compound in an amount of at from about 0.001% to about 1.0% by weight of the composition.

18. The composition of claim 1 wherein component (a) comprises a polyethylene glycol having an average molecular weight of about 200; component (b) comprises a maltodextrin obtained by the enzyme hydrolysis of corn starch; component (d) comprises a mixture of naphthenes and paraffins having substantially 100% aliphatic components; component (f) comprises oleyl alcohol; component (g) comprises triethanolamine; component (h) comprises phosphoric; the composition further comprising a sufficient amount of a monosodium phosphate buffer compound in an amount of from about 0.1 to about 8% by weight of the composition; and the composition further comprising a acetoxy-dimethoxydioxane bacteriostat in an amount of at from about 0.001% to about 1.0% by weight of the composition.

19. The composition of claim 1 wherein component (a) is present in an amount of from about 1% to about 2.0% by weight of the composition; component (b) is present in an amount of from about 4.0% to about 6% by weight of the composition; component (c) is present in an amount of from about 0.2% to about 0.2% by weight of the composition; component (d) is present in an amount of from about 8% to about 12% by weight of the composition; component (e) is present in an amount of from about 0.5% to about 1% by weight of the composition; component (f) is present in an amount of from about 0.4% to about 0.6% by weight of the composition; component (g) is present in an amount of from about 0.03% to about 0.05% by weight of the composition; component (h) is present in an amount of from about 0.02% to about 0.05% by weight of the composition.

20. The composition of claim 19 further comprising from about 1% to about 3% by weight of the composition of a monosodium phosphate buffer and from about 0.05% to about 0.2% by weight of the composition of at least one bacteriostat compound.

* * * * *